US005944546A

United States Patent [19]

Miyake et al.

[11] Patent Number: 5,944,546

[45] Date of Patent: Aug. 31, 1999

[54] COAXIAL CONNECTOR FOR SWITCHING ANTENNAS

[75] Inventors: Yukinori Miyake; Tetsuya Ozaki; Norimasa Nishimatu; Takeshi Nobe, all of Tokyo, Japan

[73] Assignee: Hirose Electric Co., Ltd., Tokyo, Japan

[21] Appl. No.: 09/032,999

[22] Filed: Mar. 2, 1998

[30] Foreign Application Priority Data

Mar. 6, 1997 [JP] Japan ..... 9-067508

[51] Int. Cl.[6] ..... H01R 29/00

[52] U.S. Cl. ..... 439/188; 439/944; 200/51.03

[58] Field of Search ..... 439/188, 944; 200/51.03, 51.05, 51.09, 51.12

[56] References Cited

U.S. PATENT DOCUMENTS

| | | | |
|---|---|---|---|
| 4,666,231 | 5/1987 | Sheesley et al. | 439/188 |
| 5,453,019 | 9/1995 | Garver et al. | 439/188 |
| 5,538,435 | 7/1996 | Yohn | 439/188 |
| 5,580,261 | 12/1996 | Meynier | 439/188 |
| 5,839,910 | 11/1998 | Meller et al. | 439/188 |

FOREIGN PATENT DOCUMENTS

| | | |
|---|---|---|
| 05022178 | 1/1993 | Japan . |
| 06223924 | 12/1994 | Japan . |

*Primary Examiner*—Steven L. Stephan
*Assistant Examiner*—Hae Moon Hyeon
*Attorney, Agent, or Firm*—Kanesaka & Takeuchi

[57] ABSTRACT

A flexible detecting terminal (6) is provided within an inside connector (1) in the vicinity of the cylindrical outer conductor (5) which surrounds a central conductor (4). An outside connector (52) has a central conductor (52A) for connection with the central conductor (4) and a conductive shell (52B) fitted over the cylindrical outer conductor (5). A contact section (6B) is provided on the detecting terminal (6) such that when the connectors (1) and (52) are not connected to each other, it is spaced from the cylindrical outer conductor (5) but when the connectors (1) and (52) are connected to each other, it is brought into resilient contact with the cylindrical outer conductor (5).

2 Claims, 4 Drawing Sheets

COAXIAL CONNECTOR FOR SWITCHING ANTENNAS

BACKGROUND OF THE INVENTION

1. Filed of the Invention

The present invention relates to coaxial connectors for antenna switch.

2. Description of the Related Art

In order to switch from the inside antenna connected to the receiving circuit of a mobile phone or the like to the outside antenna mounted on a vehicle, it is necessary to connect the outside coaxial connector for the outside antenna to the inside coaxial connector for the receiving circuit. Such a coaxial connector consisting of the inside and outside connectors is disclosed in Japanese patent application Kokai No. 223924/94.

As FIG. 4 shows, the connector comprises an inside connector 51 having a central conductor 51A and an outer conductor 51B and an outside connector 52 having a central conductor 52A and an outer conductor 52B. The inside and outside connectors 51 and 52 are provided in a connecting device 53 of a mobile phone 50 and a connecting device 54 of a vehicle, respectively. A signal connector 57 or 58 having a plurality of signal terminals 55 or 56 is provided between the inside or outside connectors 51 or 52. Each signal terminal 55 has a connection section 55A for connection to a predetermined circuit trace by soldering.

A pair of switching terminals 59 and 60 are provided above the signal terminals of the connection device 53. The switching terminal 59 is provided with a curved contact section 59A for contact with the other switching terminal 60. The switching terminal 60 is provided with an L-shaped projection 60A. When the L-shaped projection 60A is pushed upwardly, the switching terminal 60 is flexed as shown by broken line and separated from the contact section 59A.

Under the illustrated conditions, the switching terminals 59 and 60 make a closed circuit via a power source 61 and an exciting coil 62 to attract a movable contact 64 of a switch 63 to an inside antenna 65. Consequently, a transmitter/receiver circuit 66 is connected to the inside antenna 65.

When the connecting device 54 is plugged in the connecting device 53, not only the signal connectors 57 and 58 but also the inside and outside connectors 51 and 52 are connected to each other. At this point, the outer conductor 52B of the right-side outside connector 52 pushes upwardly the projection 60A of the switching terminal 60 to flex the switching terminal 60 as shown by broken line. Consequently, the two switching terminals 59 and 60 are separated to stop the energizing of the exciting coil 62 so that the movable contact 64 is brought into contact with the lower point. Thus, the transmitter/receiver circuit 66 is connected to the central conductor 51A for making transmission/reception via the outside antenna.

In such a coaxial connector, merely plugging the connecting device 54 of the outside antenna into the connecting device 53 of the mobile phone 50, it is possible to switch from the inside antenna 65 of the mobile phone 50 to the outside antenna.

However, for the above switching operation, it is necessary to provide two complicated switching terminals 59 and 60 and a space for the switching terminals, resulting in the increased size of the connector. Consequently, the number of components, the number of assembling steps, and the manufacturing costs are increased. Especially, it is difficult to reduce the distance between the inside connectors 51. Since the switching terminals are provided above the signal terminals, the height of the connector is also increased.

SUMMARY OF THE INVENTION

Accordingly, it is an object of the invention to provide a compact and simple coaxial connector for switching antennas.

According to the invention there is provided a coaxial connector for switching between a first antenna connected to an electrical circuit of a device and a second antenna provided outside the device, which comprises an inside connector having a first central conductor and a cylindrical outer conductor connected to the electrical circuit; an outside connector having a second central conductor connected to the second antenna and a conductive shell provided around the second central conductor; a flexible detecting terminal provided in vicinity of the cylindrical outer conductor; a contact section provided on the detecting terminal such that when the inside and outside connectors are not connected to each other, it is spaced from the cylindrical outer conductor but when the inside and outside connectors are connected to each other, it is brought into resilient contact with the conductive shell which has been fitted over the cylindrical outer conductor. Consequently, the first antenna is switched to the second antenna.

It is preferred that the cylindrical outer conductor is provided with a cutout at a position corresponding to the contact section of the detecting terminal to assure the separation between the detecting terminal and the cylindrical outer conductor.

DESCRIPTION OF THE PREFERRED EMBODIMENT

Embodiments of the invention will now be described with respect to the accompanying drawings.

Figure 1:
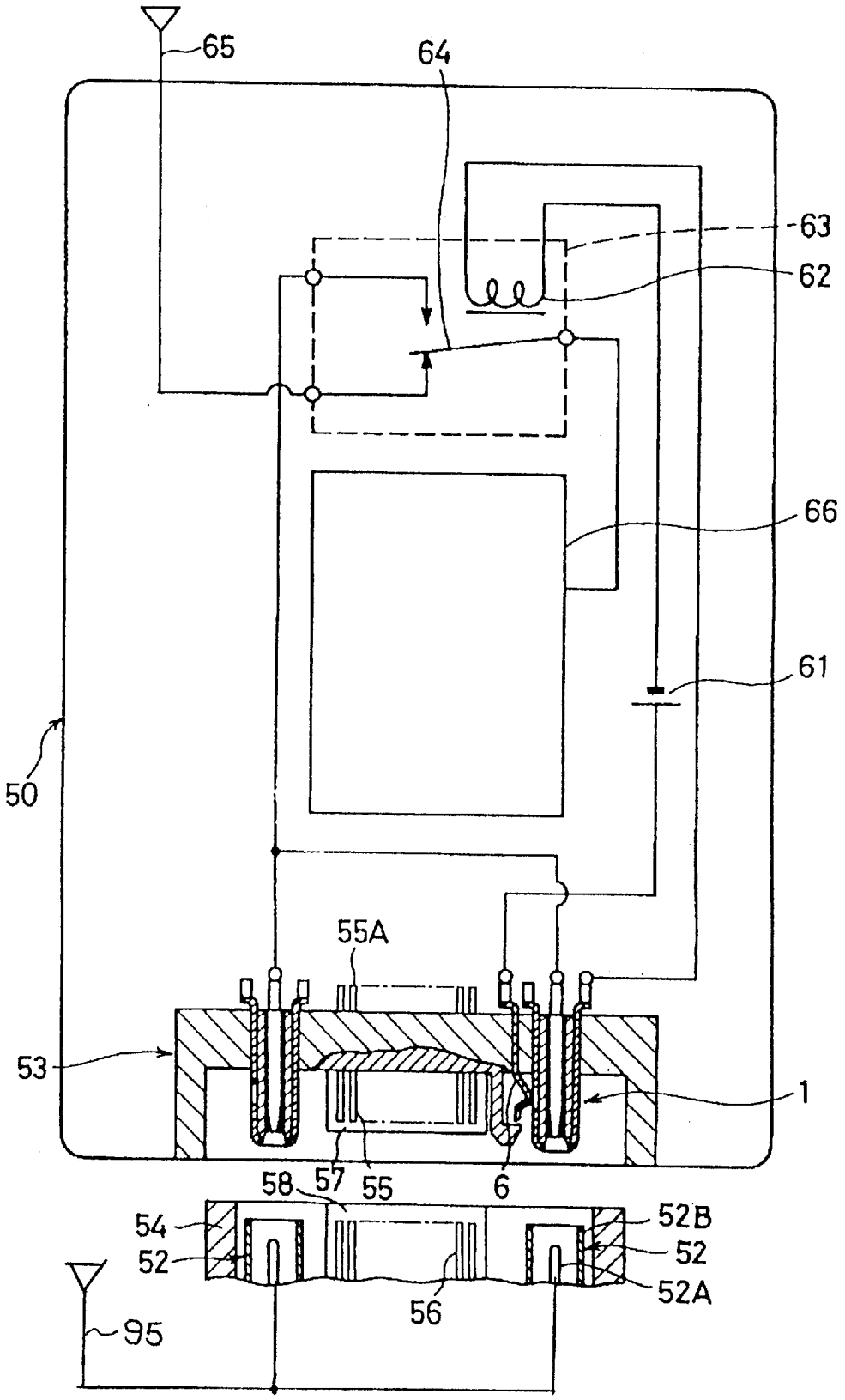
FIG. 1 is a schematic diagram of a mobile phone having a connector according to an embodiment of the invention.
Figure 4:
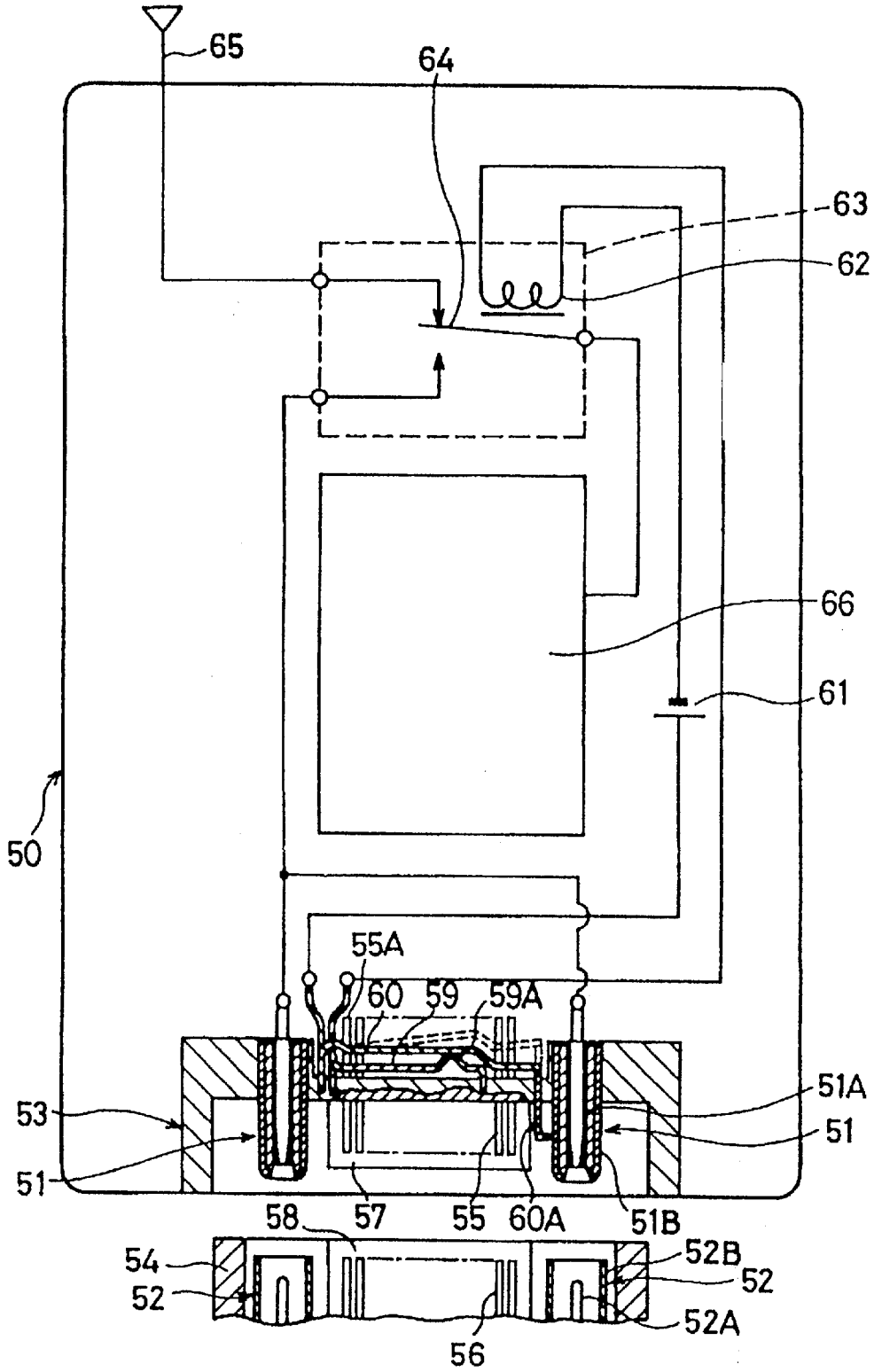
FIG. 4 PRIOR ART
FIG. 4 is a schematic diagram of a mobile phone employing a conventional connector.

In FIG. 1, the same components as those of the conventional one shown in FIG. 4 are given the same reference numbers, and their description is omitted.

The mobile phone 50 is provided with the connecting device 53 to which a signal connector 57 is attached. A pair of coaxial inside connectors 1 are provided on opposite sides of the signal connector 57.

Figure 2:
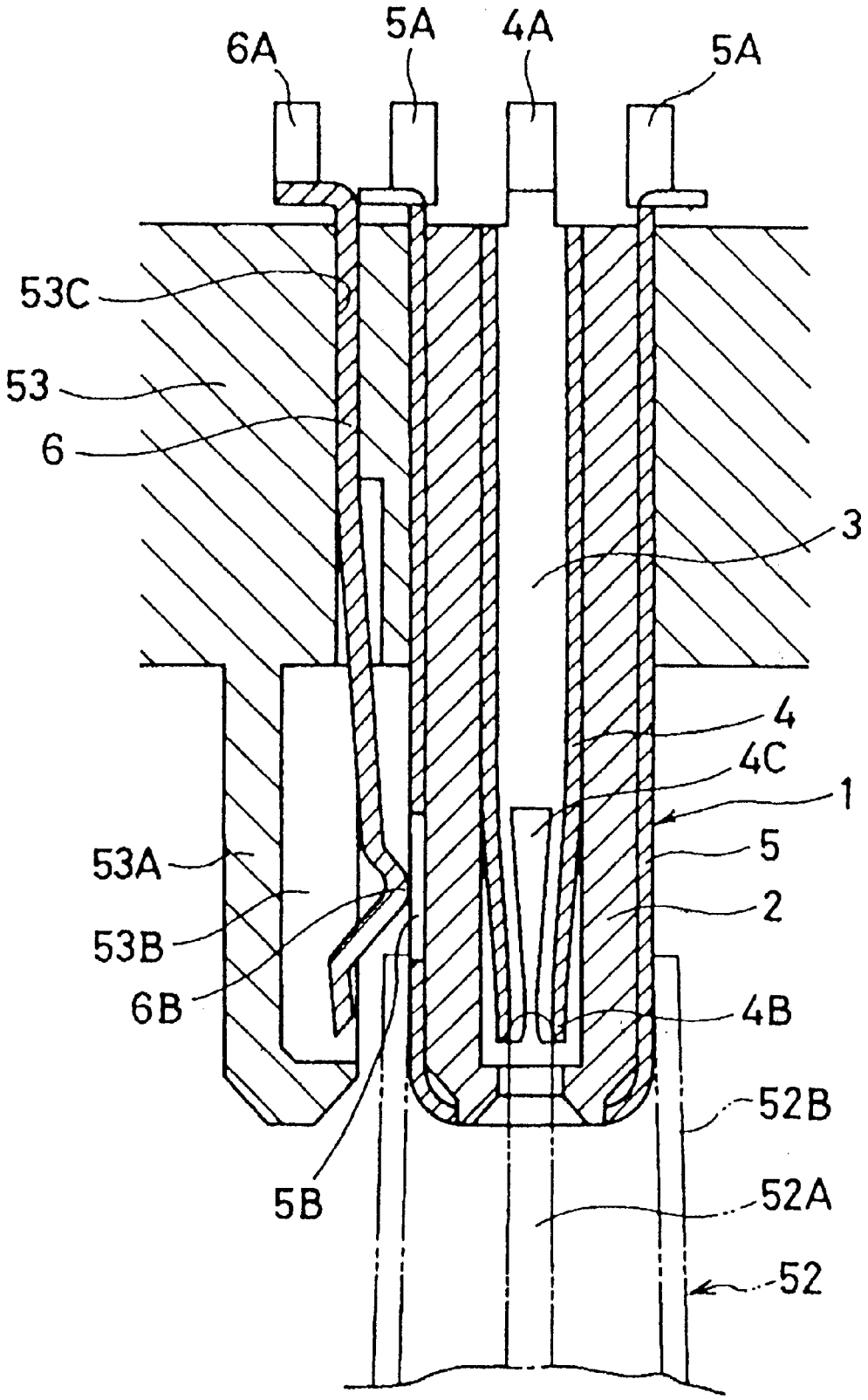
FIG. 2 is a sectional view of the connector which is not connected to an outside connector.

As FIG. 2 shows, the inside connector 1 comprises an insulative body 2 having a cavity 3, a female central conductor 4 provided in the cavity 3, and a cylindrical outer conductor 5 outside the insulative body 2 to provide excellent high frequency characteristics. The central and outer conductors 4 and 5 are provided with connection terminals 4*a* and 5A, respectively. A slit 4C is provided at the lower end of the central conductor 4 to facilitate resilient expansion. A cutout 5B is provided in the lower portion of the outer conductor 5.

A protective wall 53A extends downwardly from the insulative body of the connecting device 53 so as to face the cutout 5B of the outer conductor 5 and has a recess 53B. When no protective wall is provided, the distance between the two inside connectors can be reduced further. A detecting terminal 6 is held in a groove 53C of the connecting device 53 such that its free end becomes flexible. The detecting terminal 6 has an upper connection section 6A and a lower contact section 6B in front of the cutout 5B of the outer conductor 5. The contact section 6B is provided at a position such that when the central conductor 52A of the outside connector 52 contacts the lower end 4B of the central conductor 4, the upper end of the outer conductor 52B is in the vicinity of the contact section 6B.

Under the conditions of FIGS. 1 and 2, the circuit including the power source 61 and the exciting coil 62 is opened at the detecting terminal 6 and the outer conductor 5 so that the exciting coil 62 is not energized. Consequently, the movable contact 64 of the switch 63 is connected to the inside antenna 65.

When the connecting device 54 of the outside antenna 95 is plugged into the connecting device 53 of the mobile phone 50, the central conductor 52A of the outside connector 52 is brought into contact with the central conductor 4 of the inside connector 1 while the outer conductor shell 52B is fitted over the cylindrical outer conductor 5 as shown by broken line in FIG. 2. That is, the central conductors 52A and 4 are connected with each other, but the outer conductor shell 52B does not contact with the detecting terminal 6 but the cylindrical outer conductor 5.

Figure 3:
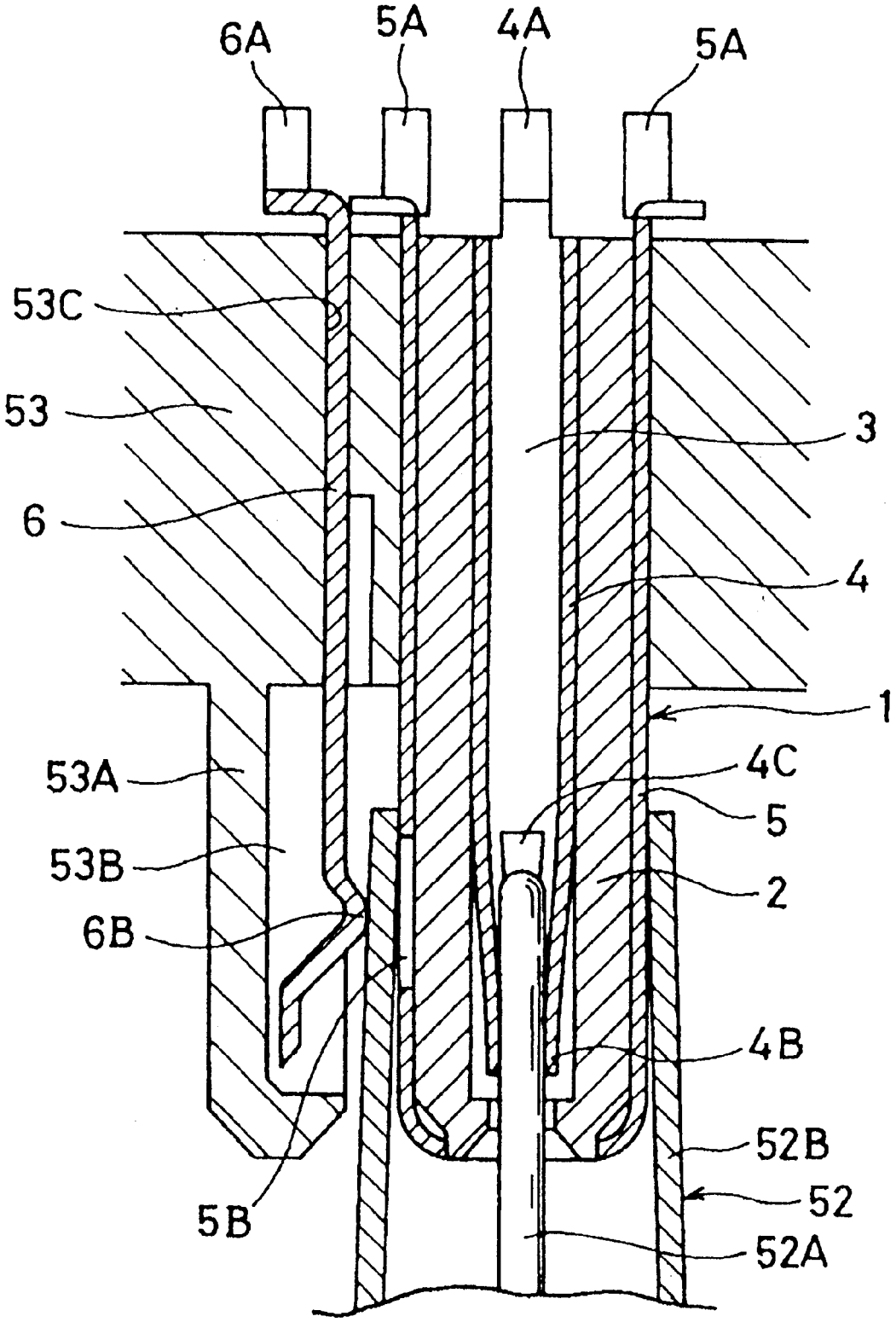
FIG. 3 is a sectional view of the connector which is connected to the outside connector.

In FIG. 3, when the outer conductor shell 52B is further fitted over the cylindrical outer conductor 5, it is brought into contact with the contact section 6B of the detecting terminal 6, with the central conductors 52A and 4 contacted. Thus, a closed circuit including the power source 61 and the exciting coil 62 is established by the connection between the cylindrical conductor 5 and the detecting terminal 6 so that the exciting coil 62 is energized to bring the movable contact 64 to the central conductor 4 of the inside connector 1 (the upper contact of FIG. 1). Consequently, the receiver circuit 66 is connected to the outside antenna via the central conductor 4 of the inside connector 1 and the outside connector 52. The signal connectors 57 and 58 have been connected at this point.

If it is certain that the contact section 6B of the detecting terminal 6 is not in contact with the cylindrical outer conductor 5 while the outsider connector 52 is not connected, the cutout 5B may be omitted.

As has been described above, a detecting terminal is provided in parallel to the cylindrical outside conductor of the inside connector to contact with the outside conductor of the outside connector to switch two antennas so that the coaxial connector for switching antennas becomes remarkably simple. If the width of a signal connector is small, it is possible to reduce the distance between the outside connectors for miniaturization. Since no switching terminal is provided above the signal terminals, the height of the connector is reduced.

What is claimed is:

1. A coaxial connector for switching between a first antenna connected to an electrical circuit of a device and a second antenna provided outside said device, comprising:

an inside connector having a first central conductor and a cylindrical outer conductor connected to said electrical circuit;

an outside connector having a second central conductor connected to said second antenna and a conductive shell provided around said second central conductor;

a flexible detecting terminal separated from provided in the vicinity of said cylindrical outer conductor;

a contact section provided on said detecting terminal such that when said inside and outside connectors are not connected to each other, it is spaced from said cylindrical outer conductor but when said inside and outside connectors are connected to each other, it is brought into resilient contact with said conductive shell which has been fitted over said cylindrical outer conductor.

2. A coaxial connector according to claim 1, wherein said cylindrical outer conductor is provided with a cutout at a position corresponding to said contact section of said detecting terminal.

* * * * *